US009625178B2

(12) United States Patent
Ota et al.

(10) Patent No.: US 9,625,178 B2
(45) Date of Patent: Apr. 18, 2017

(54) WATER HEATER ATTACHMENT METHOD AND WATER HEATER ATTACHMENT STRUCTURE

(71) Applicant: Paloma Co., Ltd., Nagoya-Shi (JP)

(72) Inventors: Masahiro Ota, Nagoya (JP); Ryosuke Umemura, Nagoya (JP)

(73) Assignee: Paloma Co., Ltd., Nagoya-Shi (JP)

( * ) Notice: Subject to any disclaimer, the term of this patent is extended or adjusted under 35 U.S.C. 154(b) by 2 days.

(21) Appl. No.: 14/601,621

(22) Filed: Jan. 21, 2015

(65) Prior Publication Data

US 2016/0033168 A1 Feb. 4, 2016

(30) Foreign Application Priority Data

Jul. 30, 2014 (JP) ..... 2014-155318

(51) Int. Cl.
*F24H 9/06* (2006.01)

(52) U.S. Cl.
CPC ..... *F24H 9/06* (2013.01)

(58) Field of Classification Search
CPC ..... F24H 9/06; A47G 1/162; A47G 1/1646; A62C 4/04; F23L 17/04
See application file for complete search history.

(56) References Cited

U.S. PATENT DOCUMENTS 5,020,760 A * 6/1991 Mayr ..... F24H 9/06 248/230.8
5,607,133 A * 3/1997 Markham ..... F24H 9/06 248/146
5,746,405 A * 5/1998 Dvorak ..... F24H 9/06 248/146
5,971,336 A * 10/1999 McCraney ..... F16L 3/04 248/154
6,772,538 B2 * 8/2004 Vagedes ..... D06F 58/20 34/606
8,091,852 B2 * 1/2012 Vassallo ..... A47G 1/162 248/339
2003/0066939 A1 * 4/2003 Foreman ..... F16L 3/14 248/313

FOREIGN PATENT DOCUMENTS

GB 2323914 A * 10/1998 ..... F24H 9/06
JP 02-007446 U 1/1990

* cited by examiner

*Primary Examiner* — Jun Yoo
(74) *Attorney, Agent, or Firm* — Burr & Brown, PLLC

(57) ABSTRACT

A water heater attachment method is a method for attaching a water heater body to a wall surface by using an attachment member provided at a rear end of an upper surface of the water heater body. The method includes a first step of inserting a tip of a rod member into a through hole formed in the attachment member, the rod member projecting forward from the wall surface, a second step of sliding the attachment member toward the wall surface along the rod member to shift the water heater body to an attachment position of the wall surface, and a third step of fastening the attachment member to the wall surface by a screw in a state where the attachment member is held by the rod member.

3 Claims, 10 Drawing Sheets

33
4A(4)
9
10
1
P
3A
20
30
22
5
25
42
42
40
W
2
3B
15

WATER HEATER ATTACHMENT METHOD AND WATER HEATER ATTACHMENT STRUCTURE

This application claims the benefit of Japanese Patent Application Number 2014-155318 filed on Jul. 30, 2014, the entirety of which is incorporated by reference.

BACKGROUND OF THE INVENTION

Field of the Invention

The present invention relates to a water heater attachment method for attaching a water heater body of a water heater to a wall surface, and a water heater attachment structure for attaching the water heater body of the water heater to the wall surface, by using an attachment member provided at a rear end of an upper surface of the water heater body.

Background Art

Japanese Utility Model Application Publication H2-7446 (JP-UM-A-2-7446), for example, discloses a complex-type combustor which includes an air supply and exhaust pipe on a rear surface of a case that houses a water heating heat exchanger and a bath reheating heat exchanger. This type of combustor introduces and exhausts air from and to the outside via the air supply and exhaust pipe. The case of the complex-type combustor is generally attached to an inner surface (inner wall surface) of a wall of a house or building. The air supply and exhaust pipe is inserted through a wall through hole penetrating the wall of the house or building, and projects to the outside of the house or building.

Similarly to the foregoing complex-type combustor, a type of water heater includes piping such as an air supply and exhaust pipe communicating with the interior of a water heater body and projecting rearward from a rear surface of the water heater body to the outside of the house or building. For attaching this type of water heater to the inner wall surface, an attachment member provided at a rear end of an upper surface of the water heater body is fastened to the inner wall surface with screws, and the piping is inserted through a wall through hole penetrating the wall of the house or building.

At the time of attachment of the water heater to the inner wall surface, the water heater body needs to be held and pressed against the inner wall surface. Since the water heater body is a heavy unit, it is difficult to attach the water heater to the inner wall surface by an ordinary person who is not a skilled person, such as a general purchaser. In addition, while holding and pressing the water heater body against the inner wall surface, it is difficult to visually recognize the wall through hole provided behind the water heater body. In this case, there is a possibility that the piping projecting from the rear surface of the water heater body collides with the wall surface, and thus the piping may be broken. Therefore, there has been a need for a water heater easily attachable to the wall surface.

SUMMARY OF THE INVENTION

It is an object of the invention to provide a water heater attachment method for attaching a water heater, and a water heater attachment structure for the water heater capable of facilitating attachment of the water heater to a wall surface.

For achieving the aforementioned object, a first aspect of the invention is a water heater attachment method for attaching a water heater body to a wall surface by using an attachment member provided at a rear end of an upper surface of the water heater body. The water heater attachment method includes a first step, a second step and a third step. In the first step, a tip of a rod member is inserted into a through hole formed in the attachment member. The rod member projects forward from the wall surface. In the second step, the attachment member, through which the rod member has been inserted in the first step, is slid toward the wall surface along the rod member so that the water heater body is shifted to an attachment position of the wall surface. In the third step, the attachment member is fastened to the wall surface by a screw in a state where the attachment member is held by the rod member.

A second aspect of the invention is a water heater attachment method for attaching a water heater body to an inner wall surface by using an attachment member provided at a rear end of an upper surface of the water heater body in a state where piping is inserted into a wall through hole penetrating a wall. The piping communicates with the interior of the water heater body and projects rearward from a rear surface of the water heater body. The water heater attachment method includes a first step, a second step, a third step and a fourth step. In the first step, a tip of a rod member is inserted into a through hole formed in the attachment member. The rod member projects forward from the wall surface. In the second step, the attachment member, through which the rod member has been inserted in the first step, is slid toward the inner wall surface along the rod member so that the water heater body is shifted to an attachment position of the inner wall surface and also the piping is inserted into the wall through hole. In the third step, the attachment member is fastened to the inner wall surface by a screw in a state where the attachment member is held by the rod member. In the fourth step, a connection member is fastened to an outer wall surface by a screw, and the connection member is connected to a tip of the piping that has been inserted into the wall through hole in the second step.

A third aspect of the invention is directed to the water heater attachment method of the second aspect of the invention. In the method, a positioning member including a first positioning mark and a second positioning mark is used. The first positioning mark is to be brought into contact with the inner wall surface and positioned at a position corresponding to the wall through hole. In a state where the first positioning mark is positioned at the position corresponding to the wall through hole, the second positioning mark is positioned at a position where the rod member is fitted such that the rod member extends forward from the inner wall surface. Prior to execution of the first step, the first positioning mark is positioned at the position corresponding to the wall through hole, and the rod member is fitted to the position of the inner wall surface where the second positioning mark is positioned. The rod member is fitted such that the rod member projects forward.

A fourth aspect of the invention is a water heater attachment structure for attaching a water heater body to an inner wall surface by using an attachment member provided at a rear end of an upper surface of the water heater body in a state where piping is inserted into a wall through hole penetrating a wall. The piping communicates with the interior of the water heater body and projects rearward from a rear surface of the water heater body. The water heater attachment structure includes a rod member projecting forward from the inner wall surface, a through hole formed in the attachment member, and a connection member connected to a tip of the piping inserted into the wall through hole. The rod member is inserted into the through hole. The attachment member is fastened to the inner wall surface by a screw in a state where the rod member is inserted into the through hole and supports the attachment member. The connection member connected to the tip of the piping inserted into the wall through hole is fastened to an outer wall surface by a screw.

According to the first aspect of the invention, the water heater body is easily shifted to the attachment position of the wall surface, by only sliding the attachment member provided on the water heater body toward the wall surface along the rod member in the second step.

Moreover, in the third step, the water heater body is hung by the rod member via the attachment member. In this case, the attachment member can be fitted to the attachment position of the wall surface without needs of keeping holding the water heater body, and therefore the attachment member can be easily fastened to the wall surface by a screw.

Accordingly, the method of this aspect of the invention facilitates attachment of the water heater body to the wall surface.

According to the second aspect of the invention, the water heater body is easily shifted to the attachment position of the inner wall surface, and the piping of the water heater body is easily inserted into the wall through hole without collision between the inner wall surface and the piping, by only sliding the attachment member provided on the water heater body toward the inner wall surface along the rod member in the second step.

Moreover, in the third step, the water heater body is hung by the rod member via the attachment member. In this case, the attachment member can be fitted to the attachment position of the inner wall surface without needs of keeping holding the water heater body, and therefore the attachment member can be easily fastened to the inner wall surface by a screw. In addition, the piping of the water heater body does not move within the wall through hole in a state where the attachment member is fitted to the attachment position. Accordingly, the piping is prevented from colliding with the inner surface of the wall through hole, and thus prevented from being broken.

Furthermore, in the fourth step, the connection member connected to the tip of the piping is fastened to the outer wall surface by a screw. With this configuration, the piping is kept inserted through the wall through hole without collision of the piping with the inner surface of the wall through hole.

Accordingly, the method of this aspect of the invention facilitates attachment of the water heater body to the wall surface.

According to the third aspect of the invention, the positioning member is brought into contact with the inner wall surface in a state where the first positioning mark of the positioning member is positioned at the position corresponding to the wall through hole, and the rod member is fitted to the position of the inner wall surface corresponding to the second positioning mark of the positioning member such that the rod member extends forward. As a result, the rod member is securely fitted to the predetermined position of the inner wall surface so as to project from the predetermined position.

According to the fourth aspect of the invention, the attachment member is fitted to the attachment position of the inner wall surface in a state where the attachment member of the water heater body is held by the rod member. This configuration facilitates fastening of the attachment member to the inner wall surface by a screw.

Moreover, the connection member connected to the tip of the piping of the water heater body is fastened to the outer wall surface by a screw. With this configuration, the piping is kept inserted through the wall through hole without collision with the inner surface of the wall through hole.

Accordingly, the structure of the fourth aspect of the invention facilitates attachment of the water heater body to the wall surface.

DETAILED DESCRIPTION OF THE INVENTION

Figure 1:
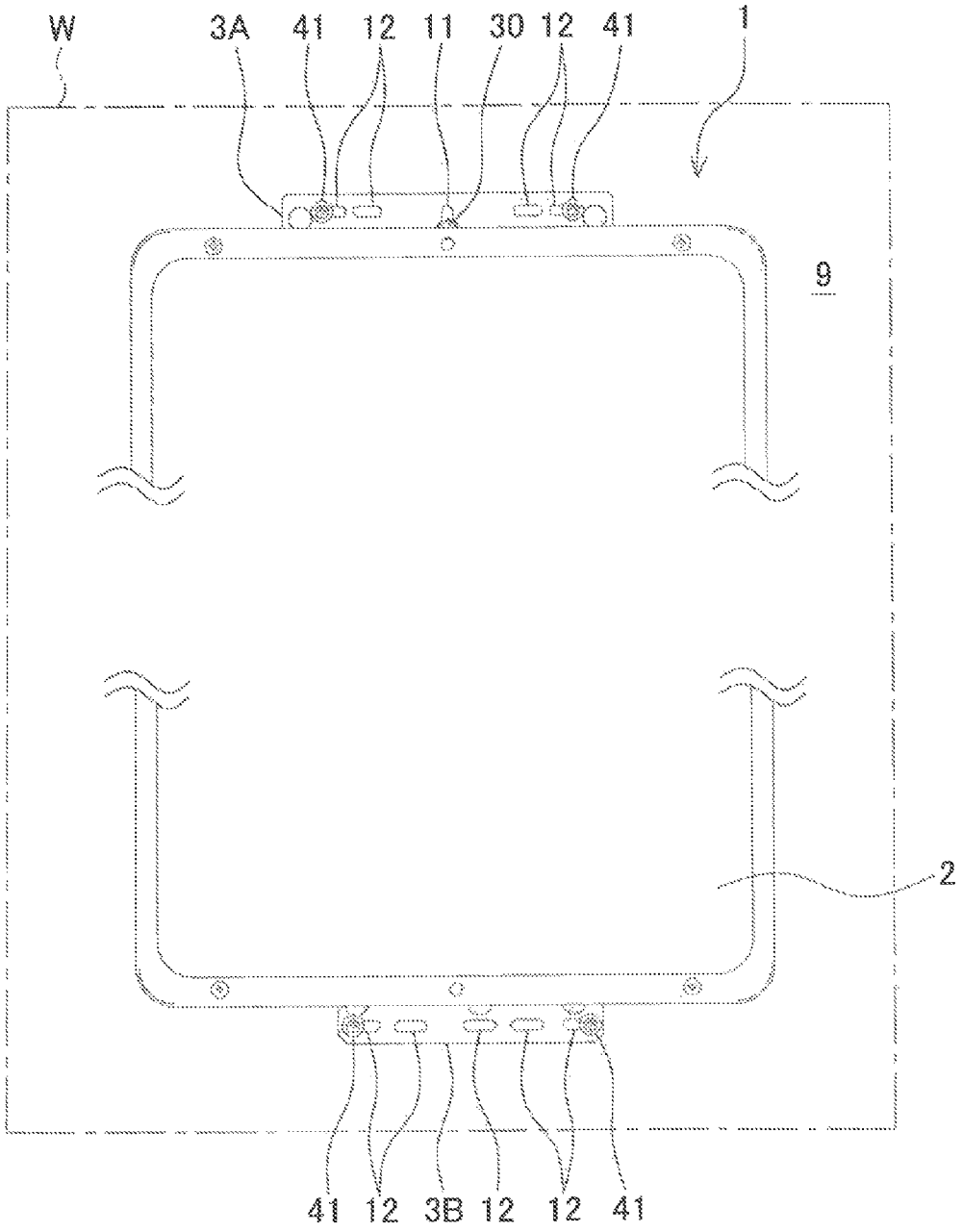
FIG. 1 is a front view illustrating a condition in which a gas water heater is fixed to an inner wall surface according to an embodiment of the invention.

An attachment structure of a gas water heater 1 according to an embodiment of the invention is hereinafter described with reference to FIGS. 1 through 6, and FIG. 10. As illustrated in FIGS. 1 through 4, the gas water heater 1 includes a water heater body 2, attachment members 3 (3A and 3B), an air supply and exhaust pipe 4, and a connection member 5. The water heater body 2 has a rectangular shape elongated in the up-down direction (up-down direction in FIGS. 1 through 4). A combustion chamber 6 (see FIG. 10) is provided inside the water heater body 2. A burner for burning gas, and a heat exchanger 7 (see FIG. 10) disposed above the burner and connecting with a water supply pipe and a hot-water delivery pipe are provided inside the combustion chamber 6.

Figure 2:
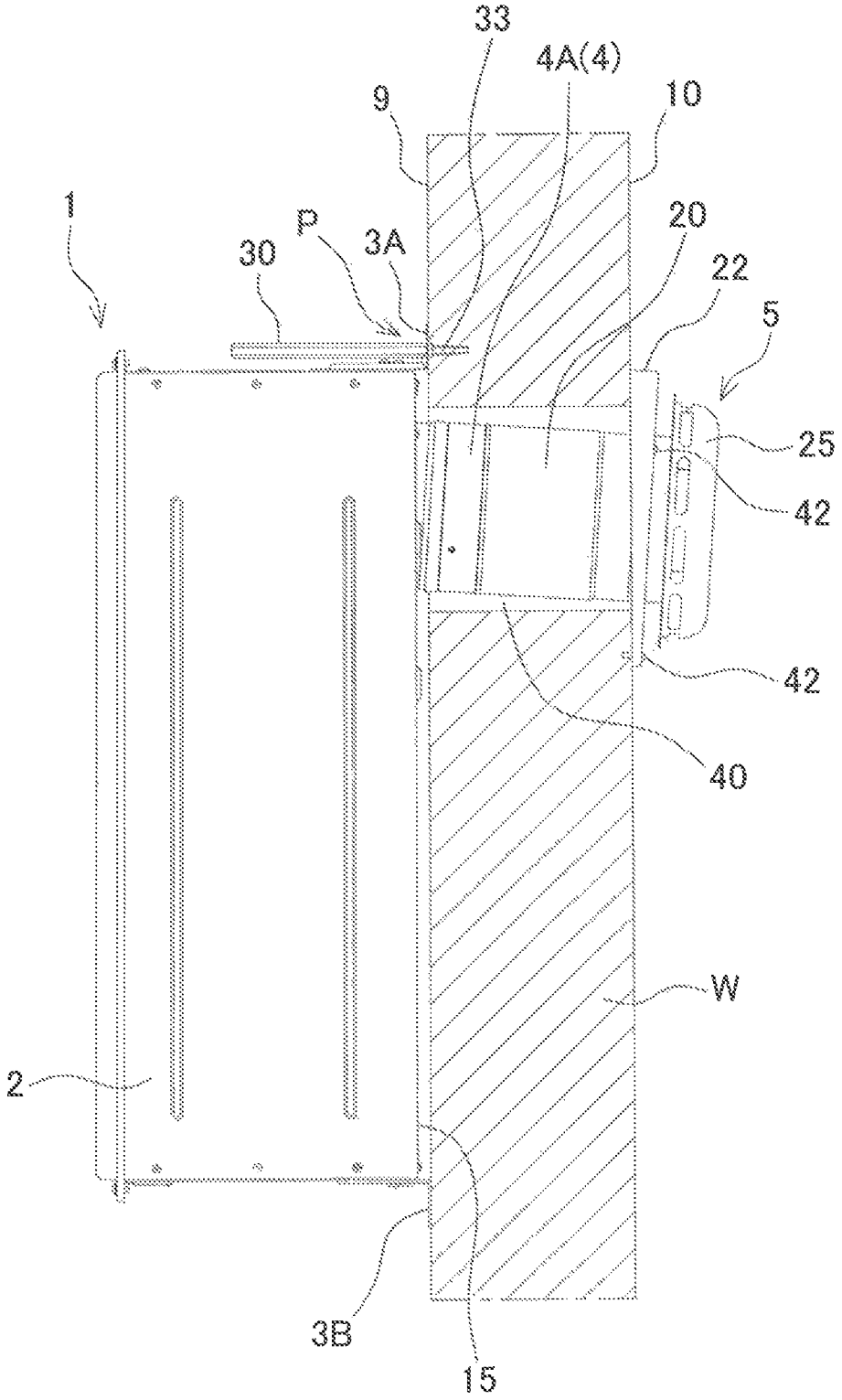
FIG. 2 is a side view partially containing a cross-sectional view, illustrating a condition in which the gas water heater is fixed to the inner wall surface, and in which a connection member connected to an air supply and exhaust pipe of the gas water heater is fixed to an outer wall surface.
Figure 3:
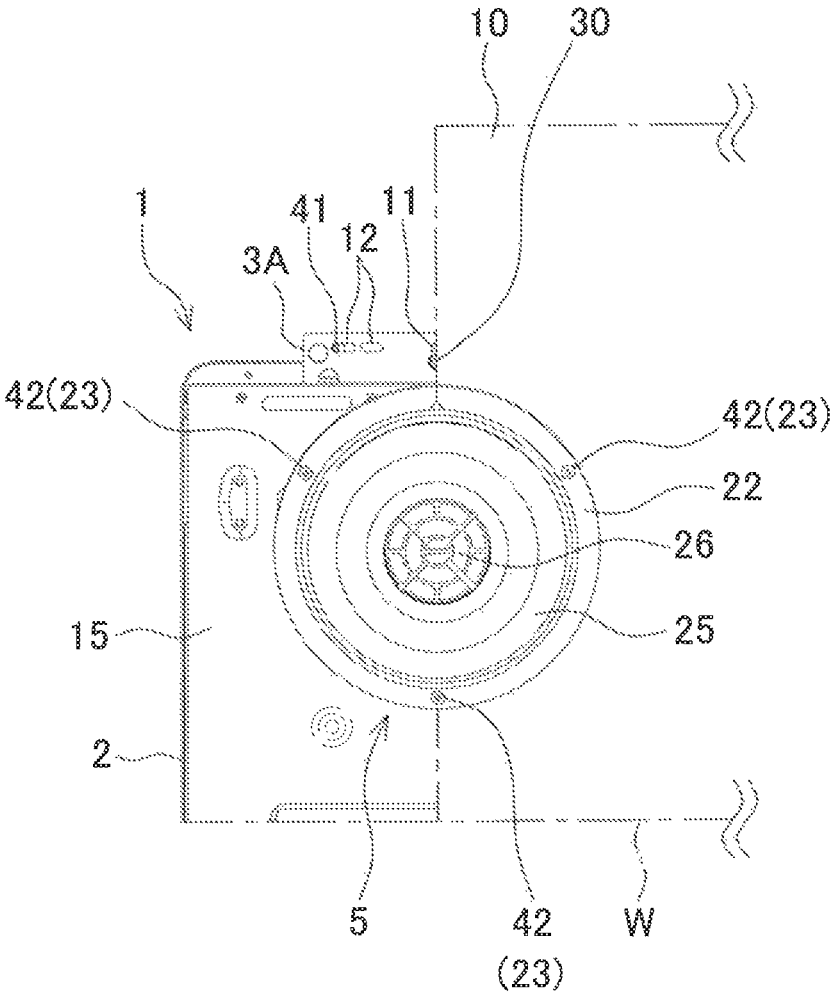
FIG. 3 is a rear view illustrating a condition in which the connection member connected to the air supply and exhaust pipe is fixed to the outer wall surface.
Figure 4:
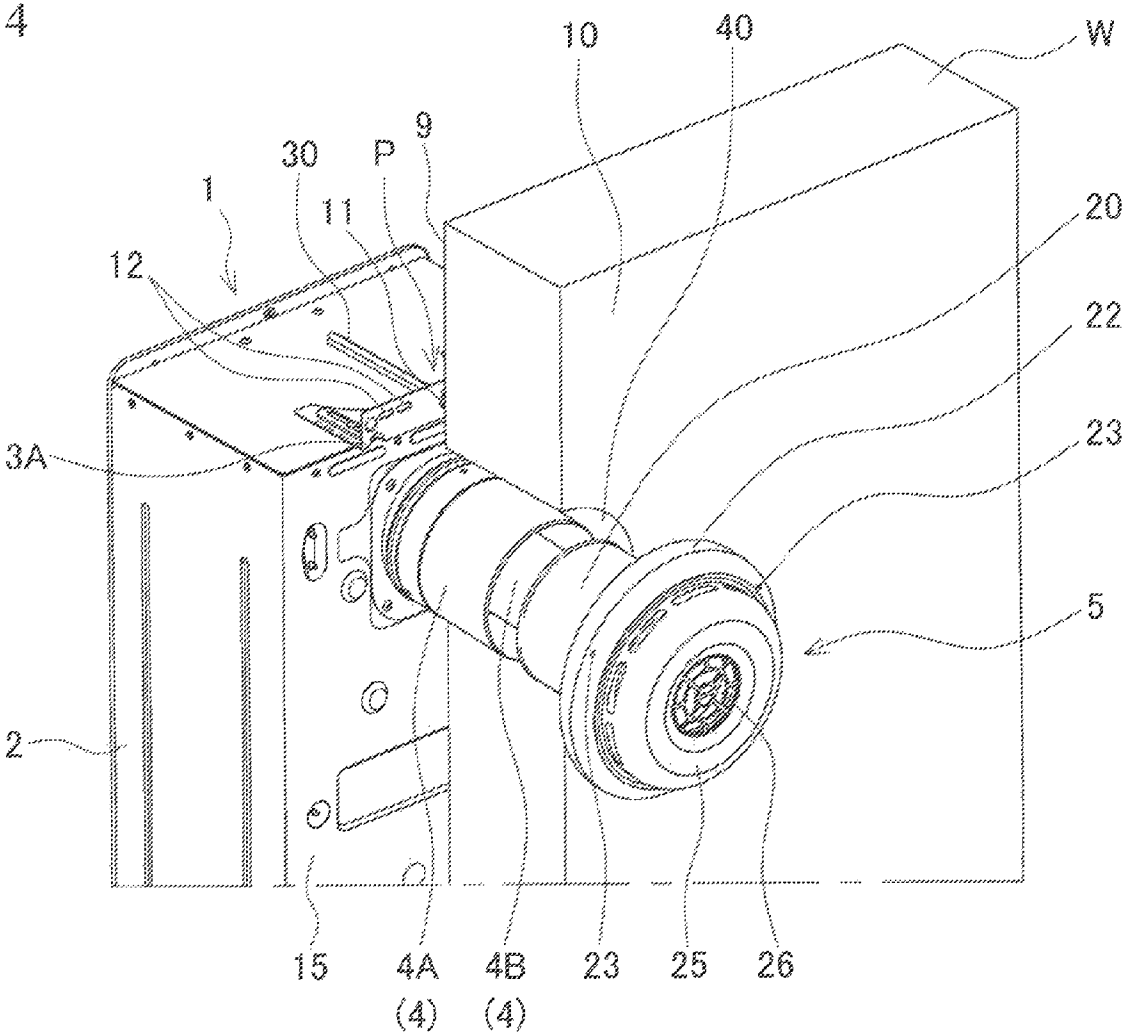
FIG. 4 is a perspective view illustrating the disassembled gas water heater and connection member.

As illustrated in FIGS. 2 and 4, the attachment member 3A projects in the up-down direction of the water heater body 2 from a rear end of an upper surface of the water heater body 2 (upper right of the water heater body 2 in FIG. 2). The attachment member 3A is a component used for attachment of the water heater body 2 to an inner surface 9 (hereinafter referred to as inner wall surface 9) of a wall W of a house or building. As illustrated in FIGS. 1, 3, and 4, the attachment member 3A has one through hole 11, and four opening holes 12. The through hole 11 is disposed substantially at the center of the attachment member 3A in the front view in a position to face the inner wall surface 9. As illustrated in FIG. 1, the through hole 11 has a shape constituted by a round hole portion and a vertical hole portion formed continuously from the round hole portion and extended upward from the center of the circumferential surface of the upper half of the round hole portion. Each of the opening holes 12 is constituted by a long hole elongated in the lateral direction. Two of the opening holes 12 are disposed at the upper left end of the attachment member 3A and arranged side by side in the lateral direction, while the other two opening holes 12 are disposed at the upper right end of the attachment member 3A and arranged side by side in the lateral direction.

As illustrated in FIGS. 1 and 2, the attachment member 3B projects downward toward below the water heater body 2 from a rear end of a lower surface of the water heater body 2 (lower right of the water heater body 2 in FIG. 2). The attachment member 3B is also a component used for attachment of the water heater body 2 to the inner wall surface 9. As illustrated in FIG. 1, the attachment member 3B has five opening holes 12. The five opening holes 12 are formed in the lower part of the attachment member 3B, and arranged linearly in the lateral direction.

The air supply and exhaust pipe 4 illustrated in FIGS. 2 and 4 projects from a rear surface 15 of the water heater body 2 toward the rear side (right side in FIG. 2) of the water heater body 2. The air supply and exhaust pipe 4 is configured to include a supply pipe 4A, and an exhaust pipe 4B accommodated in the supply pipe 4A in a condition coaxial with the supply pipe 4A. The supply pipe 4A communicates with a supply path formed within the water heater body 2 as a path through which combustion air is supplied to the burner provided within the combustion chamber 6. On the other hand, the exhaust pipe 4B communicates with an exhaust path formed within the water heater body 2 above the heat exchanger 7, through which path combustion gas generated from the burner flows. The air supply and exhaust pipe 4 is an example of piping according to the invention.

The connection member 5 illustrated in FIGS. 2 through 4 and FIG. 10 has a double-cylinder structure constituted by a supply cylinder 20 (see FIG. 10), and an exhaust cylinder 21 (see FIG. 10) accommodated in the supply cylinder 20 in a condition coaxial with the supply cylinder 20. A disk-shaped flange 22 surrounds the circumference of a tip (right side in FIGS. 2 and 10) of the supply cylinder 20. The flange 22 is a component used for fixing the connection member 5 to an outer surface 10 (hereinafter referred to as outer wall surface 10) of the wall W. As illustrated in FIG. 3, the flange 22 has three screw holes 23 at equal intervals on the circumference of the flange 22 in positions to face the outer wall surface 10. The tip side (right side in FIGS. 2 and 10) of the exhaust cylinder 21 projects from the tip surface of the supply cylinder 20, and an exhaust cover 25 is fixed to the tip surface of the exhaust cylinder 21. The exhaust cover 25 has an exhaust opening 26 (see FIGS. 3 and 4) communicating with the exhaust cylinder 21. The exhaust cover 25 further has a plurality of supply holes 24 (see FIG. 10) configured to communicate with the clearance between the inner surface of the supply cylinder 20 and the outer surface of the exhaust cylinder 21.

Figure 5:
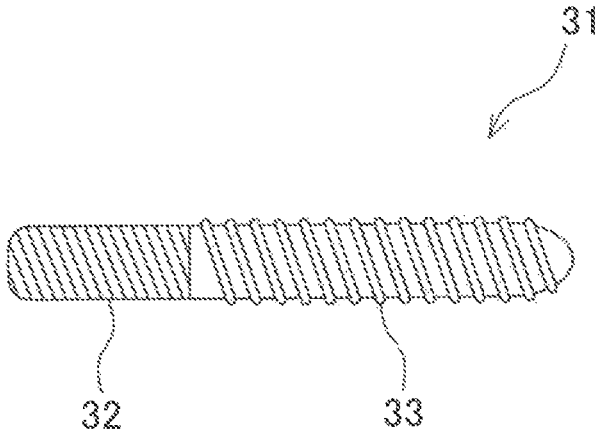
FIG. 5 is a plan view illustrating a hanger bolt screwed into the inner wall surface.
Figure 6:
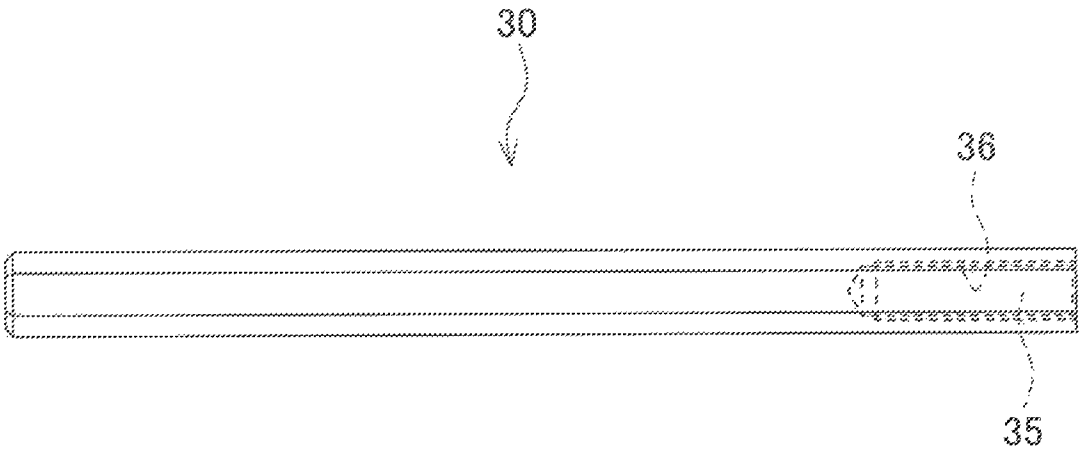
FIG. 6 is a plan view illustrating a rod member brought into screw-engagement with the hanger bolt screwed into the inner wall surface.
Figure 10:
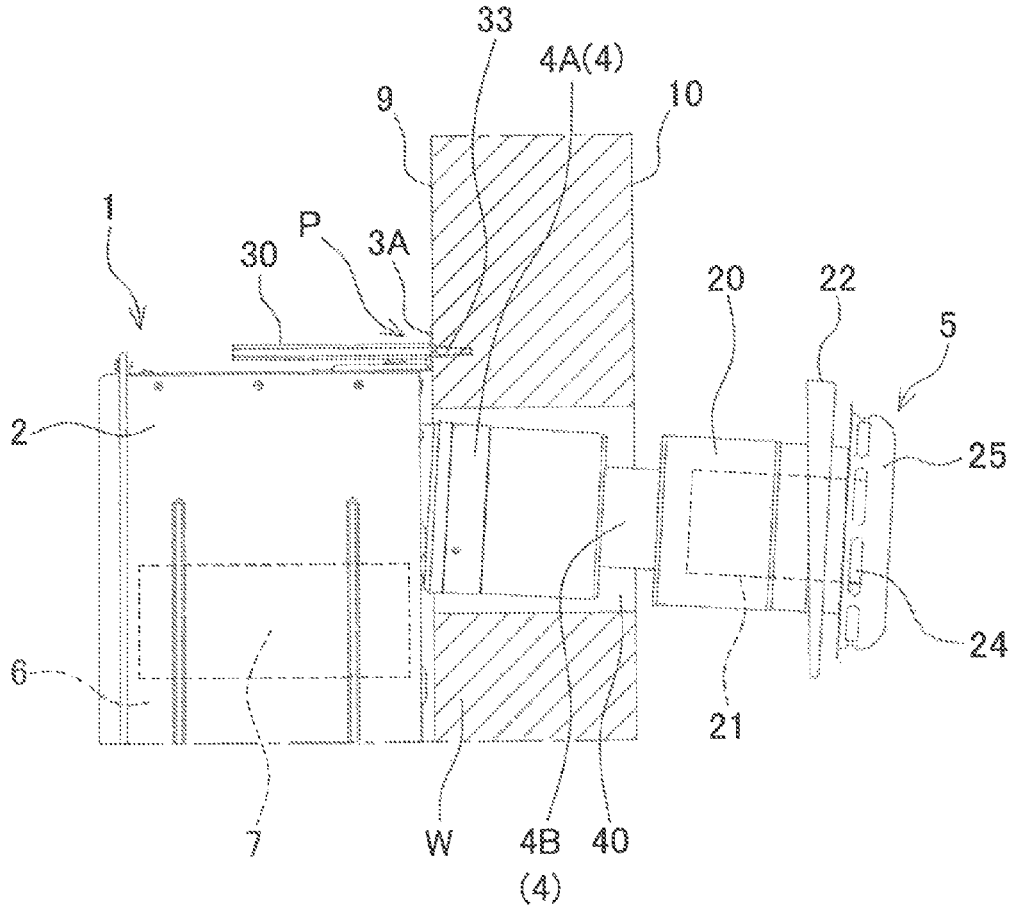
FIG. 10 is a figure illustrating a step for connecting the connection member to the air supply and exhaust pipe inserted into the wall through hole.

As illustrated in FIGS. 1, 2, and 4, a rod member 30 is attached in such a manner as to horizontally project forward (left side in FIG. 2) from the inner wall surface 9 by using a hanger bolt 31 illustrated in FIG. 5. More specifically, the rod member 30 is attached in such a manner as to horizontally project forward from the inner wall surface 9 by a method described below. As illustrated in FIG. 5, the hanger bolt 31 is made of metal, and constituted by a shaft body which has a male screw portion 32 at one end, and threads on the outer surface of the other end constituting a screw shaft 33. On the other hand, the rod member 30 is a solid cylindrical body which is made of metal and has a hexagonal cross section as illustrated in FIG. 6. A screw hole 35 is provided at the rear end (right side in FIG. 6) of the rod member 30. A female screw portion 36 is formed in the inner surface of the screw hole 35. The female screw portion 36 is brought into screw-engagement with the male screw portion 32 of the hanger bolt 31. The tip of the rod member 30 is attached to a hexagonal socket of an electric tool in the condition of screw-engagement between the female screw portion 36 and the male screw portion 32. Then, the electric tool is actuated to screw the screw shaft 33 of the hanger bolt 31 into the inner wall surface 9. As a result, the rod member 30 is attached in such a manner as to horizontally project forward from the inner wall surface 9 as illustrated in FIGS. 2 and 4. The rod member 30 is a component inserted into the through hole 11 (see FIGS. 1 and 4) of the attachment member 3 at the time of attachment of the water heater body 2 to the inner wall surface 9. In addition, as illustrated in FIGS. 2 and 10, the wall W to which the water heater body 2 is fixed has a wall through hole 40 penetrating the wall W from the inner wall surface 9 to the outer wall surface 10.

The gas water heater 1 constructed as above is attached to the inner wall surface 9 in a manner described below. As illustrated in FIGS. 1, 2, and 4, the rod member 30 is inserted into the through hole 11 (round hole portion) of the attachment member 3A. The attachment member 3A held by the rod member 30 is fastened to the inner wall surface 9 while pressed against an attachment position P (see FIGS. 2 and 4) in the inner wall surface 9 to which the attachment member 3A is attached, in a state where screws 41 (see FIG. 1) are inserted into the respective opening holes 12 of the attachment member 3A. In addition, the attachment member 3B is fastened to the inner wall surface 9 while pressed against an attachment position in the inner wall surface 9 to which the attachment member 3B is attached, in a state where the screws 41 are inserted into the respective opening holes 12 of the attachment member 3B. Thus, the attachment member 3A is fastened to the attachment position P by screws, and the attachment member 3B is fastened to the attachment position by screws. As illustrated in FIGS. 2, 4 and 10, the air supply and exhaust pipe 4 (supply pipe 4A and exhaust pipe 4B) is inserted into the wall through hole 40, allowing the tip (right side in FIG. 10) of the exhaust pipe 4B to project from the wall through hole 40 to the outside of the house or building. The supply cylinder 20 of the connection member 5 shown in FIG. 10 is fitted to the outer surface of the supply pipe 4A, while the exhaust cylinder 21 of the connection member 5 is fitted to the outer surface of the exhaust pipe 4B. Thus, the connection member 5 is connected with the tip (right side in FIG. 2) of the air supply and exhaust pipe 4. Furthermore, screws 42 (see FIG. 3) are fastened to the corresponding screw holes 23 of the flange 22, and further screwed into the outer wall surface 10 in a state where the connection member 5 is connected with the tip of the air supply and exhaust pipe 4 and where the flange 22 of the connection member 5 is pressed against the outer wall surface 10. Thus, the connection member 5 is fastened to the outer wall surface 10 by screws.

According to the gas water heater 1 in this embodiment, combustion air is supplied to the burner when operation starts. The combustion air is introduced from the supply holes 24 (see FIG. 10) of the connection member 5 positioned outside the house or building, and then passes through the supply cylinder 20 (see FIG. 10) and enters the supply pipe 4A (see FIG. 10). Thereafter, the combustion air flows through the supply path formed within the water heater body 2, and is sucked toward the burner. With supply of the combustion air to the burner, combustion heat is generated from the burner and heats water supplied to the heat exchanger 7 via the water supply pipe. The heated water is delivered to the hot-water delivery pipe. The combustion gas generated from the burner passes through the exhaust path formed within the water heater body 2, and enters the exhaust pipe 4B (see FIG. 10). Then, the combustion gas flows through the exhaust cylinder 21, and is discharged from the exhaust opening 26 (see FIGS. 3 and 4) to the outside of the connection member 5.

Figure 7:
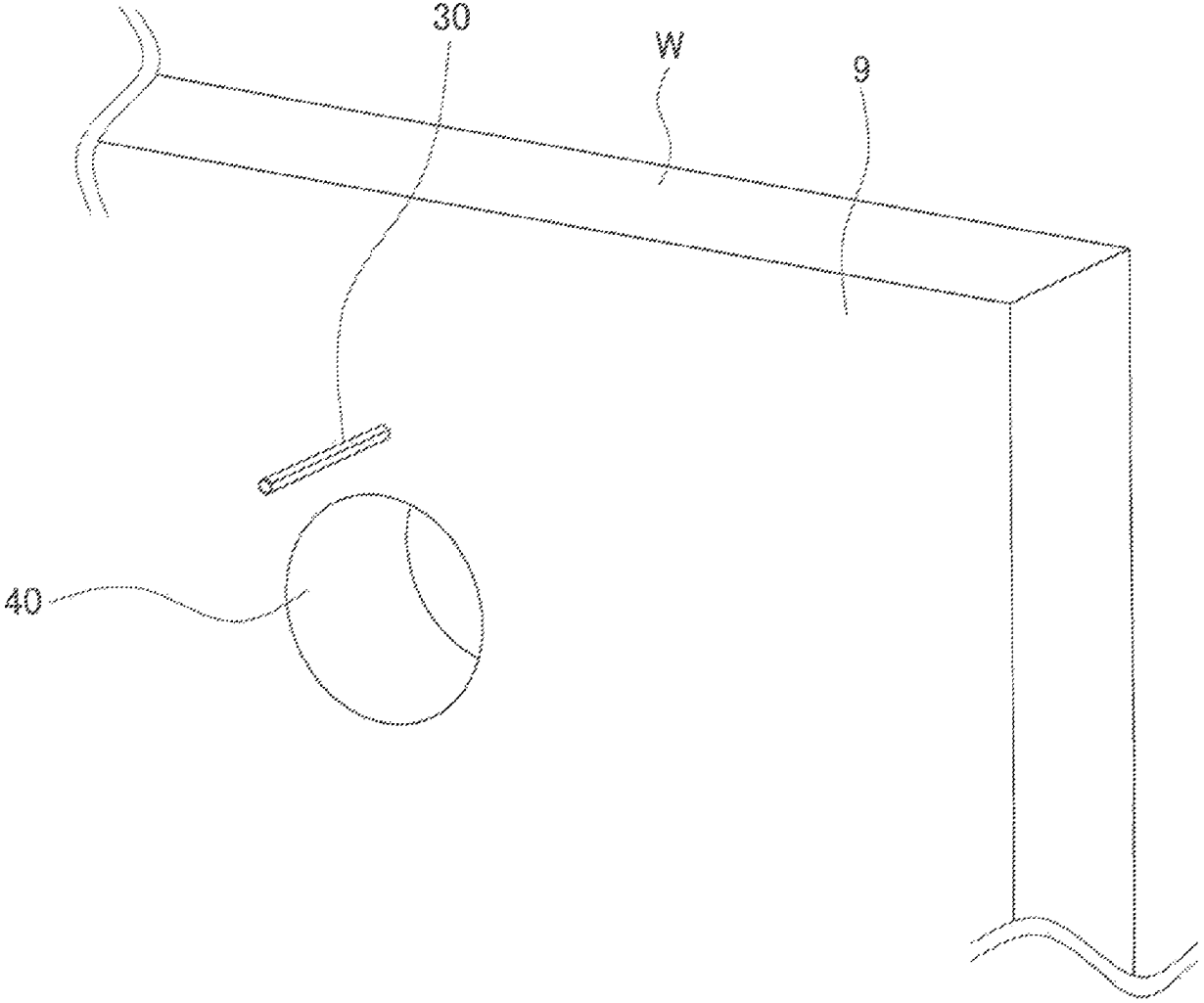
FIG. 7 is a figure illustrating a step for fixing the rod member to the inner wall surface.
Figure 8:
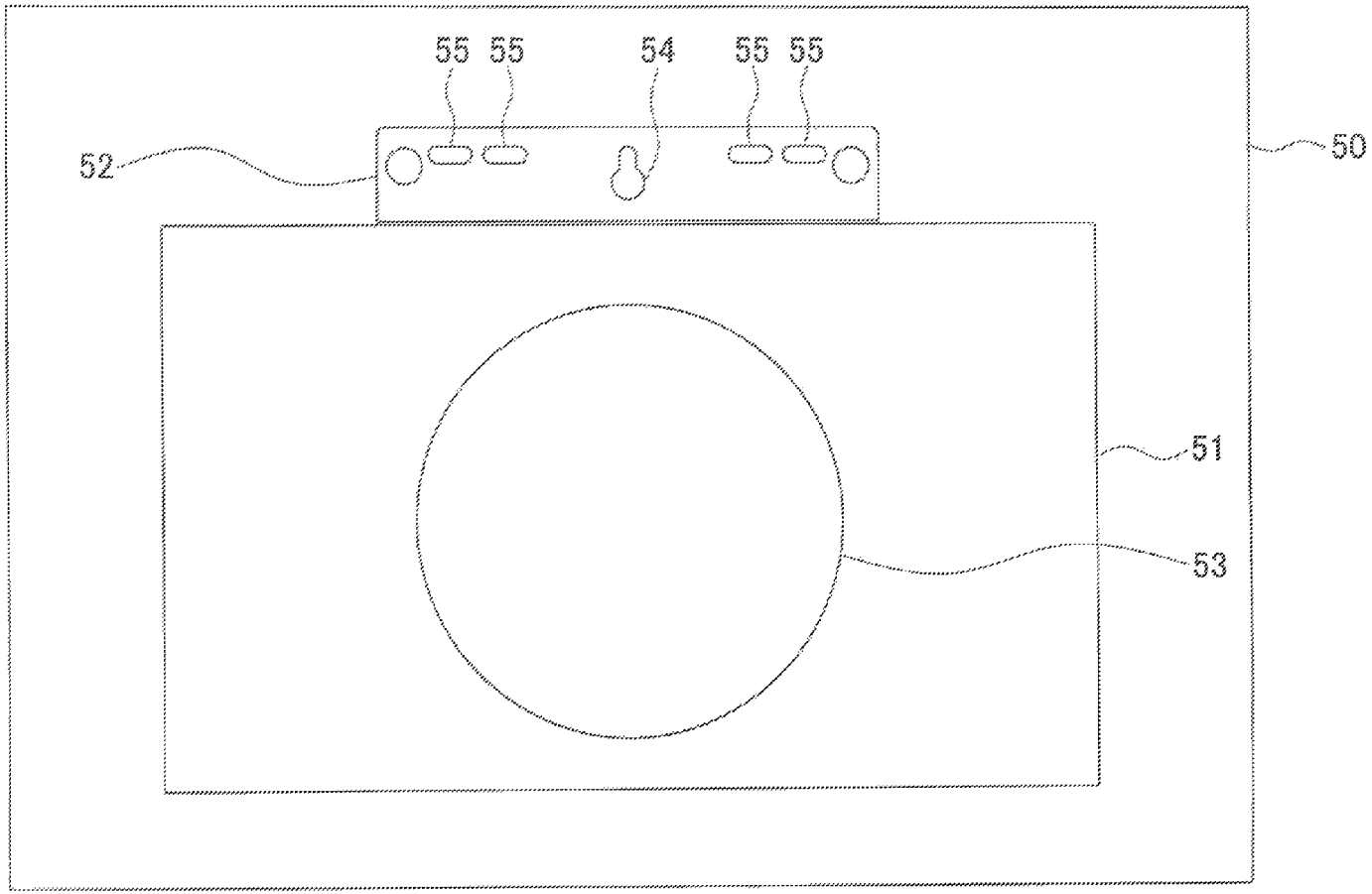
FIG. 8 is a plan view illustrating a positioning member used for fixing the rod member to the inner wall surface.

A method for attaching the gas water heater 1 is now described with reference to FIGS. 1 through 10. According to the attachment method, the rod member 30 is fitted into the inner wall surface 9 as described below with reference to FIG. 7, prior to a first step (described later). For fitting the rod member 30, a positioning member 50 shown in FIG. 8 is used. The positioning member 50 is made of paper on which a reference portion 51 and an extended portion 52 are marked. The reference portion 51 is a rectangular shape elongated in the lateral direction in the plan view. A circular first positioning mark 53 having the same radius as that of the wall through hole 40 (see FIG. 7) is marked on the reference portion 51. The extended portion 52 is provided on an upper edge of the reference portion 51. The extended portion 52 is a square portion in the plan view, and has the same planar shape as that of the attachment member 3A (see FIG. 1). A second positioning mark 54 is marked substantially at the center of the extended portion 52 in the plan view and has the same planar shape as that of the through hole 11 (see FIG. 1) of the attachment member 3A. Two third positioning marks 55 are arranged side by side in the lateral direction at the upper left end of the extended portion 52. Moreover, additional two of the third positioning marks 55 are arranged side by side in the lateral direction at the upper right end of the extended portion 52. Each of the third positioning marks 55 has the same planar shape as that of each of the opening holes 11 (see FIG. 1) of the attachment member 3A.

For fitting the rod member 30 into the inner wall surface 9, the reference portion 51 of the positioning member 50 is brought into contact with the inner wall surface 9, and the first positioning mark 53 is positioned at a position corresponding to the wall through hole 40. Then, the positioning member 50 is brought into contact with the inner wall surface 9 while the first positioning mark 53 is positioned at the position corresponding to the wall through hole 40. As a result, the second positioning mark 54 provided on the extended portion 52 comes to a position coinciding with the position to which the rod member 30 is fitted such that the rod member horizontally extends forward from the inner wall surface 9. Subsequently, a provisional hole is opened in the inner wall surface 9 at a position where the hanger bolt 31 is screwed, by sticking a perforator to a position in the second positioning mark 54, for example. In addition, other provisional holes are opened in the inner wall surface 9 at positions overlapping with the respective opening holes 12 of the attachment member 3A by sticking the perforator to positions in the respective third positioning marks 55. Thereafter, the screw shaft 33 (see FIG. 5) of the hanger bolt 31 is screwed into the provisional hole at the screwing position using an electric tool. As a result, fitting of the rod member 30 into the inner wall surface 9 is completed in such a manner that the rod member 30 horizontally extends forward from the inner wall surface 9 as illustrated in FIG. 7. According to this embodiment, secure fitting of the rod member 30 to the predetermined position of the inner wall surface 9 can be achieved by only attaching the rod member 30 to the inner wall surface 9 at the position corresponding to the second positioning mark 54 of the positioning member 50 such that the rod member 30 horizontally extends forward from the inner wall surface 9.

Figure 9:
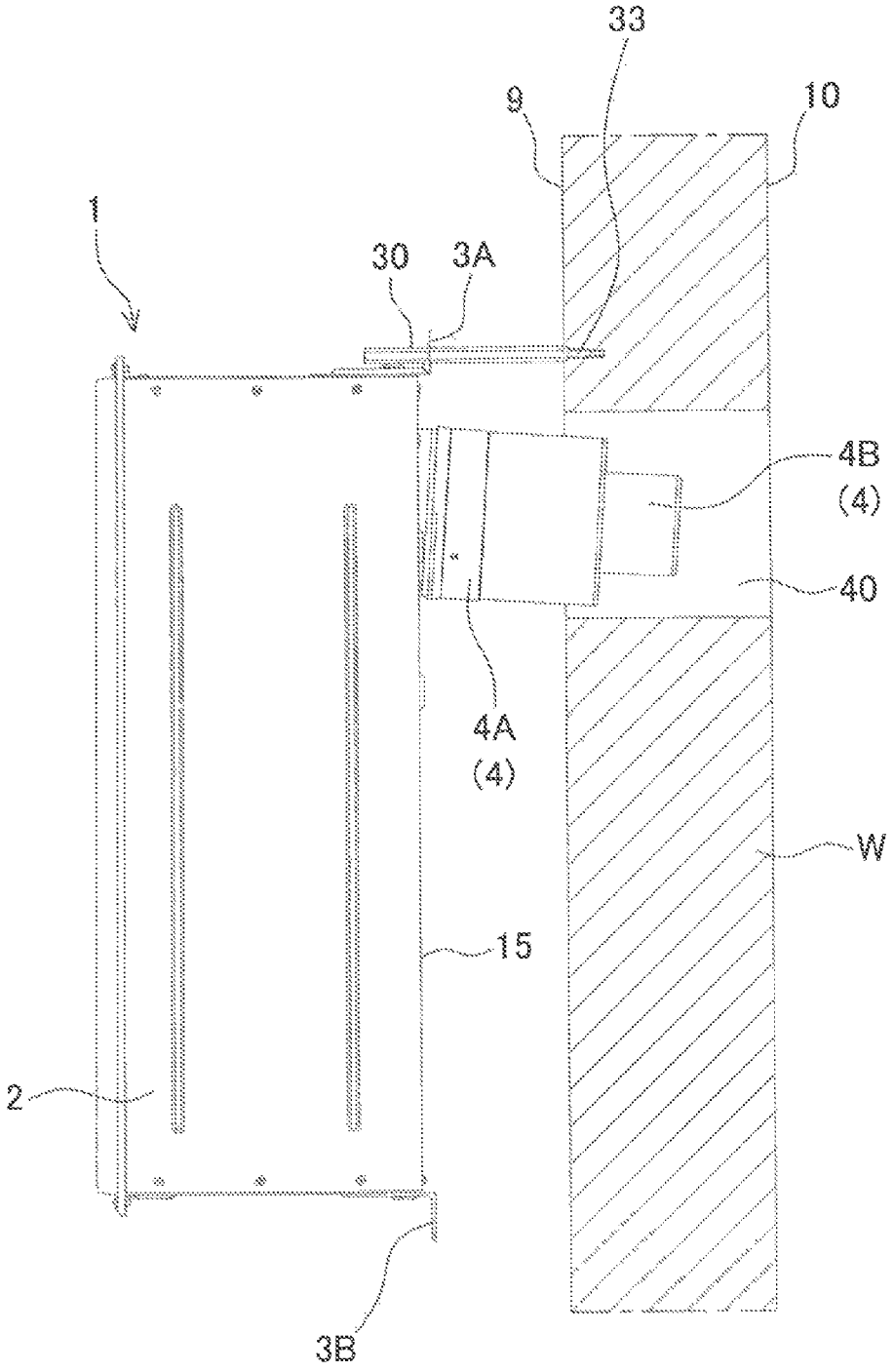
FIG. 9 is a figure illustrating a step for inserting a tip of the rod member into a through hole formed in an attachment member of a water heater body.

Then, the through hole 11 of the attachment member 3A is brought near to the rod member 30. Thereafter, as illustrated in FIG. 9, a step (hereinafter referred to as first step) for inserting the tip (left side in FIG. 9) of the rod member 30 into the through hole 11 (round hole portion) of the attachment member 3A is executed to allow the water heater body 2 to be hung by the rod member 30 via the attachment member 3A. The attachment member 3A projects from the rear end of the upper surface of the water heater body 2, and therefore does not become invisible behind the water heater body 2. Accordingly the through hole 11 of the attachment member 3A can be visibly recognized, and thus the tip of the rod member 30 can easily inserted into the through hole 11.

Then, a step (hereinafter referred to as second step) for sliding the attachment member 3A, into which the rod member 30 has been inserted in the first step, toward the inner wall surface 9 along the rod member 30 to shift the water heater body 2 to the attachment position P is executed (see FIGS. 4 and 10). In the second step, the water heater body 2 is shifted to the attachment position P, and simultaneously the air supply and exhaust pipe 4 (supply pipe 4A and exhaust pipe 4B) is inserted into the wall through hole 40 (see FIGS. 9 and 10). Then, the exhaust pipe 4B is shifted through the wall through hole 40 so as to project to the outside of the house or building. In this second step, the water heater body 2 is easily shifted to the attachment position P by only sliding the attachment member 3A toward the inner wall surface 9 along the rod member 30. In addition, the exhaust pipe 4B is easily inserted through the wall through hole 40 without collision between the inner wall surface 9 and the supply pipe 4A or the exhaust pipe 4B.

After execution of the second step, a third step described below is executed. In the third step, the attachment member 3A shifted to the attachment position P in the second step is pressed against the inner wall surface 9 in a state where the water heater body 2 is hung by the rod member 30 via the attachment member 3A. In this case, the respective opening holes 12 are positioned to the provisional holes formed in the inner wall surface 9 at the positions overlapping with the respective opening holes 12. Then, the screws 41 (see FIG. 1) are inserted into the respective opening holes 12 of the attachment member 3A, and then the screws 41 are fastened to the provisional holes of the inner wall surface 9. Thus, the attachment member 3A is fastened to the attachment position P by screws. In addition, the screws 41 are inserted into the respective opening holes 12 of the attachment member 3B, and then the screws 41 are fastened to the provisional holes of the inner wall surface 9. Thus, the attachment member 3B is fastened to the attachment position by screws. According to the third step, the water heater body 2 is hung by the rod member 30 via the attachment member 3A. Therefore, it is not necessary to keep holding the water heater body 2 while the attachment member 3A is fitted to the attachment position P. Accordingly, fastening of the attachment member 3A to the attachment position P by screws is easily achievable. In addition, in the third step, the air supply and exhaust pipe 4 (supply pipe 4A and exhaust pipe 4B) does not move within the wall through hole 40 in a state where the attachment member 3A is fitted to the attachment position P. With this configuration, the air supply and exhaust pipe 4 is prevented from colliding with the inner surface of the wall through hole 40, and thus prevented from being broken.

After the third step, a fourth step described below is executed. In the fourth step, the exhaust cylinder 21 (see FIG. 10) of the connection member 5 is fitted the outer surface of the tip of the exhaust pipe 4B projecting from the wall through hole 40 to the outside of the house or building. Then, the exhaust cylinder 21 is slid toward the rear end of the exhaust pipe 4B (left side in FIG. 10) within the wall through hole 40. In accordance with this slide, the supply cylinder 20 (see FIG. 10) of the connection member 5 is inserted into the wall through hole 40, and thereby fitted to the outer surface of the tip of the supply cylinder 4A within the wall through hole 40. Thereafter, the connection member 5 is shifted toward the outer wall surface 10 until the flange 22 (see FIG. 10) contacts the outer wall surface 10. Through these processes, connection of the connection member 5 to the tip of the air supply and exhaust pipe 4 is completed. Subsequently, in the fourth step, the flange 22 is pressed against the outer wall surface 10. With the flange 22 pressed against the outer wall surface 10, the screws 42 (see FIG. 3) are fastened to the corresponding screw holes 23 of the flange 22, and further the screws 42 are screwed into the outer wall surface 10. Thus, the connection member 5 is fastened to the outer wall surface 10 by screws. With fastening the connection member 5 connected to the tip of the air supply and exhaust pipe 4 to the outer wall surface 10 by screws in this manner, the exhaust pipe 4B is kept inserted through the wall through hole 40 without collision of the air supply and exhaust pipe 4 (supply pipe 4A and exhaust pipe 4B) with the inner surface of the wall through hole 40. Through these processes, attachment of the water heater body 2 to the inner wall surface 9 of the house or building is completed.

According to the attachment method of the gas water heater 1 in this embodiment, the water heater body 2 is easily shifted to the attachment position P, and the exhaust pipe 4B is easily inserted into the wall through hole 40 without collision between the inner wall surface 9 and the air supply pipe 4A or the exhaust pipe 4B, by only sliding the attachment member 3A provided on the water heater body 2 toward the inner wall surface 9 along the rod member 30 in the second step.

Moreover, in the third step, the water heater body 2 is hung by the rod member 30 via the attachment member 3A. In this case, the attachment member 3A is fitted to the attachment position P without needs of keeping holding the water heater body 2, and therefore the attachment member 3A is easily fastened to the attachment position P by screws. Furthermore, the air supply and exhaust pipe 4 (supply pipe 4A and exhaust pipe 4B) does not move within the wall through hole 40 in the state where the attachment member 3A is fitted to the attachment position P. Accordingly, the air supply and exhaust pipe 4 is prevented from colliding with the inner surface of the wall through hole 40, and thus prevented from being broken.

Furthermore, in the fourth step, the connection member 5 connected to the tip of the air supply and exhaust pipe 4 is fastened to the outer wall surface 10 by screws. With this configuration, the exhaust pipe 4B is kept inserted through the wall through hole 40 without collision of the air supply and exhaust pipe 4 (supply pipe 4A and exhaust pipe 4B) with the inner surface of the wall through hole 40.

Accordingly, this method facilitates attachment of the water heater body 2 to the wall surface.

In addition, the positioning member 50 (reference portion 51 and extended portion 52) is brought into contact with the inner wall surface 9 in a state where the first positioning mark 53 of the positioning member 50 is positioned at a position corresponding to the wall through hole 40. Then, the rod member 30 is fitted to the position of the inner wall surface 9 corresponding to the second positioning mark 54 of the positioning member 50 such that the rod member 30 horizontally extends forward from the inner wall surface 9. As a result, the rod member 30 is securely fitted to the predetermined position of the inner wall surface 9.

According to the structure for attaching the gas water heater 1 in this embodiment, the attachment member 3A provided on the water heater body 2 is held by the rod member 30. In this case, fitting of the attachment member 3A to the attachment position P is achievable without needs of keeping holding the water heater body 2. This configuration facilitates fastening of the attachment member 3A to the attachment position P by screws.

Moreover, the connection member 5 connected to the tip of the air supply and exhaust pipe 4 of the water heater body 2 is fastened to the outer wall surface 10 by screws. With this configuration, the exhaust pipe 4B is kept inserted through the wall through hole 40 without collision between the air supply and exhaust pipe 4 (supply pipe 4A and exhaust pipe 4B) with the inner surface of the wall through hole 40

Accordingly, this structure facilitates attachment of the water heater body 2 to the wall surface.

The invention is not limited to the aforementioned embodiment, but may be practiced with changes of a part of the configurations without departing from the scope and spirit of the invention. The example to which the invention is applied in the embodiment is the gas water heater 1 which has the air supply and exhaust pipe 4 projecting from the rear surface 15 of the water heater body 2 toward the rear side. However, the invention is not limited to this example. The invention may be applied to a gas water heater which has an air supply and exhaust pipe projecting from the upper surface of the water heater body toward above, for example. In this case, the first step discussed above, a step for sliding the attachment member 3A, into which the rod member 30 has been inserted in the first step, toward the inner wall surface 9 along the rod member 30 to shift the water heater body to the attachment position P (see FIGS. 4 and 10) in lieu of the second step, and the third step discussed above may be executed. In this case, the water heater body is allowed to easily shift to the attachment position P only by sliding the attachment member 3A toward the inner wall surface 9 along the outer surface of the rod member 30 in the step in lieu of the second step. This process facilitates attachment of the water heater body to the wall surface. The step in lieu of the second step is an example of a second step defined in claim 1 of the invention. Moreover, the invention may be applied to a water heater which has piping such as an air supply and exhaust pipe not projecting from the water heater body.

Furthermore, the invention may be applied to a gas water heater which has the supply pipe 4A and the exhaust pipe 4B individually projecting rearward from the rear surface 15 of the water heater body, for example, as well as the gas water heater 1 which has the air supply and exhaust pipe 4 projecting from the rear surface 15 of the water heater body 2 toward the rear side as in this embodiment. In this alternative, one wall through hole into which the supply pipe 4A is inserted, and another wall through hole into which the exhaust pipe 4B is inserted are separately formed in a wall to which the water heater body is fixed. Then, a connection member connected to the tip of the supply pipe 4A inserted into the one wall through hole is fastened to the outer wall surface by screws, while a connection member connected to the tip of the exhaust pipe 4B inserted into another wall through hole is fastened to the outer wall surface by screws. The supply pipe 4A and the exhaust pipe 4B thus constructed are considered as an example of piping according to the invention.

According to the foregoing embodiment, the step for fitting the rod member 30 to the inner wall surface 9 is included in the attachment method of the gas water heater 1. However, the invention is not limited to this example. The rod member 30 may be fitted to the inner wall surface 9 beforehand prior to attachment of the water heater body 2 to the wall, as a process different from the attachment process, for example. In this case, the first step through the fourth step discussed above are only executed in the attachment method of the gas water heater 1. According to the foregoing embodiment, the water heater body 2 is attached to the wall of the house or building. Alternatively, the wall through hole 40 may be formed in a wall of a warehouse, for example, and the water heater body 2 may be attached to this wall by a method similar to the foregoing method for attaching the water heater body 2 to the house or building. In addition, after attachment of the water heater body 2 to the inner wall surface 9, the rod member 30 may be kept engaged with the hanger bolt 31, or may be removed from the hanger bolt 31. When the rod member 30 is kept engaged with the hanger bolt 31, such an advantage is offered which allows the attachment member 3A to be supported by the rod member 30 when the screws 41 are separated from the opening holes 12 of the attachment member 3A. In addition, such an advantage is offered which facilitates sliding of the attachment member 3A along the rod member 30 in the direction of separating the attachment member 3A from the inner wall surface 9 at the time of removal of the water heater body 2 from the inner wall surface 9 on occasions such as failures and replacement.

According to the foregoing embodiment, the through hole 11 of the attachment member 3A has the shape constituted by the round hole portion and the vertical hole portion formed continuously from the round hole portion and extended upward from the center of the circumferential surface of the upper half of the round hole portion. However, the invention is not limited to this example. The through hole 11 may be constituted only by a round hole portion, for example. According to the foregoing embodiment, the gas water heater 1 includes both the attachment members 3A and 3B. However, the invention is not limited to this example. The gas water heater 1 may be configured to include only the attachment member 3A, for example. According to the foregoing embodiment, the tip of the exhaust pipe 4B shown in FIG. 10 projects from the wall through hole 40 to the outside of the house or building when the water heater body 2 is attached to the wall surface. However, the invention is not limited to this example. The tip of the exhaust pipe may be accommodated in the wall through hole 40 when the water heater body 2 is attached to the wall surface, for example. In this case, the supply cylinder 20 shown in FIG. 10 may be fitted to the outer surface of the supply pipe 4A within the wall through hole 40, while the exhaust pipe 21 shown in FIG. 10 may be fitted to the outer surface of this exhaust pipe within the wall through hole 40. According to the foregoing embodiment, such marks are marked on the positioning member 50 which are the circular first positioning mark 53 having the same radius as that of the wall through hole 40, the second positioning mark 54 having the same planar shape as that of the through hole 11 of the attachment member 3A, and the third positioning marks 55 each of which has the same planar shape as that of each of the opening holes 12 of the attachment member 3A. However, the invention is not limited to this example. A circular first positioning hole having the same radius as that of the wall through hole 40, a second positioning hole having the same planar shape as that of the through hole 11, and third positioning holes each of which has the same planar shape as that of each of the opening holes 12 may be formed in the positioning member 50, for example. According to the foregoing embodiment, the invention is applied to the gas water heater 1, for example. However, the invention is not limited to this example. The invention may be applied to suitable water heaters such as a bath system provided with a water heater.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A water heater attachment method for attaching a water heater body to a wall surface by using an attachment member having a through hole defined therein provided at a rear end of an upper surface of the water heater body, wherein the attachment member and the through hole both project above the upper surface of the water heater body, the method comprising:

a first step of inserting a tip of a rod member into the through hole defined in the attachment member, the rod member projecting forward from the wall surface;

a second step of sliding the attachment member, through which the rod member has been inserted in the first step, toward the wall surface along the rod member to shift the water heater body to an attachment position of the wall surface; and a third step of fastening the attachment member to the wall surface by a screw in a state where the attachment member is held by the rod member.

2. A water heater attachment method for attaching a water heater body to an inner wall surface by using an attachment member having a through hole defined therein provided at a rear end of an upper surface of the water heater body in a state where piping is inserted into a wall through hole penetrating the wall, the piping communicating with an interior of the water heater body and projecting rearward from a rear surface of the water heater body, wherein the attachment member and the through hole both project above the upper surface of the water heater body, the method comprising:

a first step of inserting a tip of a rod member into the through hole formed in the attachment member, the rod member projecting forward from the inner wall surface;

a second step of sliding the attachment member, through which the rod member has been inserted in the first step, toward the inner wall surface along the rod member to shift the water heater body to an attachment position of the inner wall surface, and also inserting the piping into the wall through hole;

a third step of fastening the attachment member to the inner wall surface by a screw in a state where the attachment member is held by the rod member; and a fourth step of fastening a connection member to an outer wall surface by a screw, the connection member being connected to a tip of the piping inserted into the wall through hole in the second step.

3. The water heater attachment method according to claim 2, further including another step executed prior to the first step, wherein a first positioning mark is positioned at a position corresponding to the wall through hole, and the rod member is fitted to a position of the inner wall surface corresponding to a second positioning mark such that the rod member projects forward, by using a positioning member containing the first positioning mark to be brought into contact with the inner wall surface and positioned to the position corresponding to the wall through hole, and the second positioning mark corresponding to the position where the rod member is fitted such that the rod member extends forward from the inner wall surface in a state where the first positioning mark is positioned at the position corresponding to the wall through hole.

* * * * *